United States Patent [19]

Yoshida

[11] Patent Number: 5,017,744

[45] Date of Patent: May 21, 1991

[54] ROLLER CONTACT DEVICE

[75] Inventor: Kazuo Yoshida, Hyogo, Japan

[73] Assignee: Mitsubishi Denki Kabushiki Kaisha, Tokyo, Japan

[21] Appl. No.: 528,984

[22] Filed: May 25, 1990

[30] Foreign Application Priority Data

May 26, 1989 [JP] Japan ..... 1-133232

[51] Int. Cl.[5] ..... H01H 1/06; H01H 1/50

[52] U.S. Cl. ..... 200/277; 200/250

[58] Field of Search ..... 200/277, 250, 290, 257, 200/258, 260

[56] References Cited

FOREIGN PATENT DOCUMENTS 20649 6/1977 Japan .
25638 6/1977 Japan .
49126 12/1977 Japan .

*Primary Examiner*—Henry J. Recla
*Assistant Examiner*—David J. Walczok
*Attorney, Agent, or Firm*—Sughrue, Mion, Zinn, Macpeak and Seas

[57] ABSTRACT

Described herein is a roller contact device wherein, upon moving a drive arm into a contact closing position, a pair of roller contacts are pressed across a pair of stationary contacts through a pair of bridge links and a pair of roller shafts by a pair of support shafts which are each forwardly pressed by a compression spring, thereby closing the contacts. In the event if there is a difference in height between the contacting surfaces of the two stationary contacts, the bridge links are inclined to hold the roller contacts securely in the contact closing positions.

6 Claims, 2 Drawing Sheets

ROLLER CONTACT DEVICE

BACKGROUND OF THE INVENTION

1. Field of the Invention

This invention relates to a roller contact device suitable for use in a tap changer or the like, and more particularly to improvement in a roller contact device having a couple of roller contacts in parallel.

2. Description of the Prior Art

Illustrated in a sectional view in FIG. 1 is a conventional roller contact device as disclosed in Japanese Utility Model Publication No. 52-25638, in which indicated at 1A and 1B are a pair of stationary contacts and at 2 is a roller contact which is to be bridged to connect the two stationary contacts and rotatably fitted on a roller shaft 3. Denoted at 4A and 4B are a pair of support shafts which are supported in bores 5*a* and 5*b* for movements toward and away from the stationary contacts 1A and 1B, respectively. The support shafts 4A and 4B are provided with bores 4*c* and 4*d* respectively in the fore end portions to support the opposite ends 3*a* and 3*b* of the roller shaft 3 tiltably and rotatably therein. Indicated at 6 are stop rings which are fitted on rear end portions of the support shafts 4A and 4B, and at 7A and 7B are compression springs which are provided in the bores 5*a* for urging the support shafts 4A and 4B toward the stationary contacts 1A and 1B, respectively.

The above-described conventional device operates in the manner as follows.

In the contact closing position, the support shafts 4A and 4B are constantly pushed forward by the compression springs 7A and 7B due to the existence of a gap space between the drive arm 5 and each stop ring 6. Consequently, the roller contact 2 is pressed against the stationary contacts 1A and 1B through the roller shaft 3.

The roller shaft 3 is tiltably supported on the support shafts 4A and 4B, so that, in case there is a difference in height between the contacting surfaces of the stationary contacts 1A and 1B, the roller contact 2 is tilted to contact invariably both of the stationary contacts 1A and 1B.

As the drive arm 5 is turned (in a direction perpendicular to the face of the drawing) by a contact opening operation, the roller contact 2 is disengaged from the stationary contacts 1A and 1B, and the support shafts 4A and 4B are each moved forward into a position where the stop ring 6 is abutted against the drive arm 5.

Although a single roller contact 2 is shown in the above-described conventional device, a pair of roller contacts are mounted in parallel as shown in FIG. 2 in a case involving an increased current capacity, using two sets of paired support shafts 4A and 4B and two sets of the compression springs 7A and 7B of FIG. 1.

The conventional roller contact device having a pair of roller contacts arranged in such a manner has problems or drawbacks that it requires an increased number of component parts as a result of the provision of two sets of support shafts 4A and 4B and two sets of compression springs 7A and 7B, which cause a number of steps in the machining process for forming bores in the drive arms to redouble and accordingly the assembling time to increase.

SUMMARY OF THE INVENTION

It is therefore an object of the present invention to solve the problems or drawbacks of the above-described prior art device, more specifically, to provide a roller contact device which has a pair of roller contacts supported parallelly in position by means of a pair of support shafts and a pair of compression springs, providing a roller contact device with a reduced number of component parts to shorten the time of the machining and assembling processes.

In accordance with the present invention, there is provided a roller contact device which includes: a pair of support shafts each movably supported at one end on a drive arm for back and forth movements in the axial direction and constantly urged in the forward direction by a compression spring; a pair of pivot shafts supported on the other ends of the support shafts; a pair of bridge links each supported at a middle portion thereof on one of the pivot shafts; a pair of roller shafts supported parallelly between confronting opposite ends of the bridge links rotatably and tiltably in the back and forth directions; a pair of roller contacts supported on the roller shafts; a pair of stationary contacts to be connected to each other as the pair of roller contacts are brought into pressed contact therewith.

The above and other objects, features and advantages of the invention will become apparent from the following description and the appended claims, taken in conjunction with the accompanying drawings which show by way of example a preferred embodiment of the invention, and which are given only for the purpose of illustration and should not be construed as limitative of the invention.

DETAILED DESCRIPTION OF THE PREFERRED EMBODIMENTS

Figure 3:
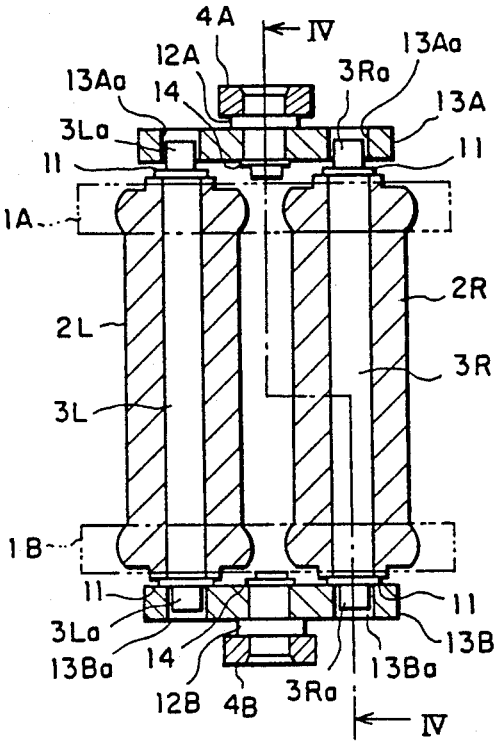
FIG. 3 shows a roller contact device according to the present invention, in a sectioned side view taken on line III—III of FIG. 4.
Figure 4:
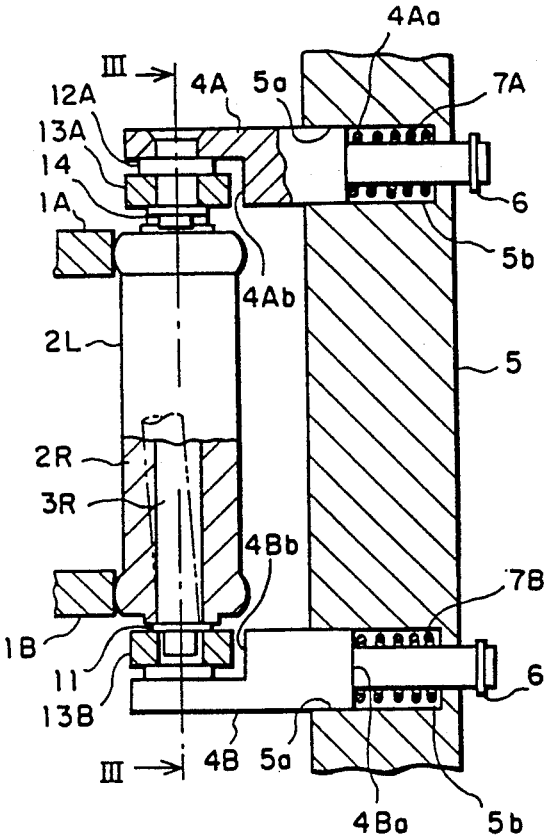
FIG. 4 is a sectioned front view of the same roller contact device taken on line IV—IV of FIG. 3.
Figure 5:
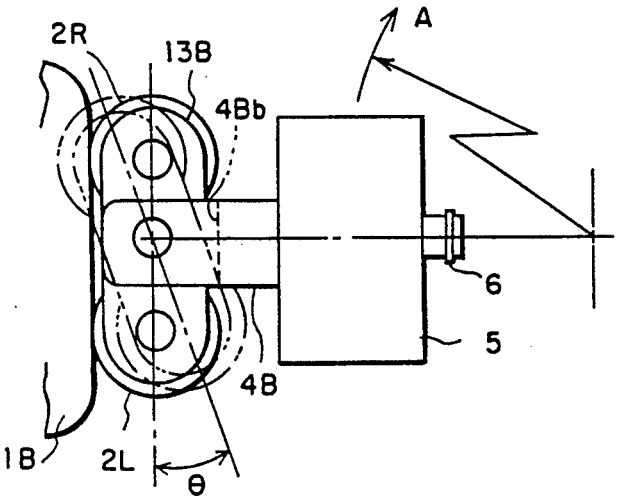
FIG. 5 is a bottom view of the roller contact device.

Illustrated in FIGS. 3 to 5 is an embodiment of the present invention in sectioned side view, sectioned front view and bottom view, respectively, in which designated at 1A and 1B are a pair of stationary contacts which are disposed parallel with each other, and at 2L and 2R are a pair of roller contacts which are disposed parallel with each other for contacting with the stationary contacts 1A and 1B and rotatably fitted on roller shafts 3L and 3R, respectively. The roller contacts 2L and 2R are retained in position on the roller shafts 3L and 3R by stop rings 11. Indicated at 4A and 4B are support shafts which are supported in bores 5*a* of a drive shaft 5 movably toward and away from the contacts 1A and 1B, and which have a stop ring 6 fitted on the respective rear ends. Compression springs 7A and 7B are fitted on these support shafts 4A and 4B between a stepped portion 5*b* of the bore 5*a* and a stepped portion 4Aa or 4Ba of the support shaft 4A or 4B to urge them constantly in the forward direction. Denoted at 12A and 12B are pivot shafts which are fixedly fitted in fore end portions of the support shafts 4A and 4B, and at 13A and 13B are a pair of bridge links which have a center portion thereof fitted in and rotatably supported by the pivot shaft 12A or 12B and are retained in position by stop rings 14 fitted on the pivot shafts 12A and 12B. The bridge links 13A and 13B are provided with bearing holes 13Aa or 13Ba in opposite end portions, in which end portions 3La and 3Ra of the roller shafts 3L and 3R are loosely fitted for rotation therein.

The bridge links 13A and 13B, which are supported rotatably about the axes of the pivot shafts 12A and 12B, are rotatable in a rotational angle range $\theta$ which is limited by abutting engagement of the bridge links 13A and 13B with the stepped portions 4Ab and 4Bb of the support shafts 4A and 4B, respectively. The stop rings 6 on the support shafts 4A and 4B are located at a predetermined space from the drive arm 5 when the both of the roller contacts 2L and 2R are closed on the stationary contacts 1A and 1B.

A clearance is provided around the journalled ends 3La and 3Ra of the roller shafts 3L and 3R in the bearing holes 13Aa and 13Bb, so that the roller shafts 3L and 3R are tiltable as indicated by chain line in FIG. 4 within the range of the clearance.

The roller contact device operates in the manner as follows.

Firstly, if the drive arm 5 is turned to close the contacts which are in open state, the support shafts 4A and 4B are moved forward through the compression springs 7A and 7B, pressing the roller contacts 2L and 2R against the stationary contacts 1A and 1B through the bridge links 13A and 13B, respectively. In this state, the stop rings 6 on the support shafts 4A and 4B are still spaced from the drive arm 5 to maintain the contacting engagement between the roller contacts 2L and 2R and the stationary contacts 1A and 1B.

As seen in the bottom view of FIG. 5, even if the contacting surfaces of the stationary contacts 1A and 1B are in an inclined state, the bridge links 13A and 13B are turned to bring the roller contacts 2L and 2R securely into contact with the stationary contacts 1A and 1B.

Further, should there be a difference in height between the contacting surfaces of the stationary contacts 1A and 1B, the play gap which is provided around the journalled ends 3La and 3Ra in the bearing holes 13Aa and 13Ra permits the roller shafts 3L and 3R to tilt to bring the roller contacts 2L and 2R into contact with the stationary contacts 1A and 1B in a reliable manner.

The pressing force of the compression spring 7A is transmitted to the roller contacts through the paths of

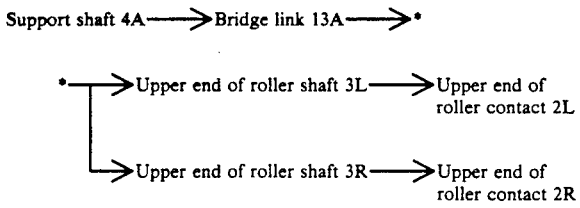

while the pressing force of the compression spring 7B is transmitted to the roller contacts through the paths of

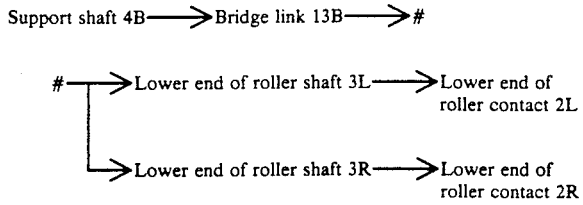

thus ensuring the contacting pressure of the roller contacts 2L and 2R against the stationary contacts 1A and 1B.

As the drive arm 5 is turned in the direction of arrow A in FIG. 5 (in a direction perpendicular to the face of FIG. 4), the roller contacts 2L and 2R are successively disengaged from the stationary contacts 1A and 1B and moved radially forward (leftward in FIG. 5) until the stop rings 6 come into abutting engagement with the drive arm 5. Accordingly, the amount of this forward projection of the roller contacts 2L and 2R can be adjusted to a desired value by suitably setting the space between the stop ring 6 and the drive arm 5.

On the other hand, the rotational angle of each of the bridge links 13A and 13B can be preset to a suitable value by way of the widths of the gap spaces between the bridge links 13A and the gap space support shaft 4A and between the bridge link 13B and the support shaft 4B respectively.

Figure 1:
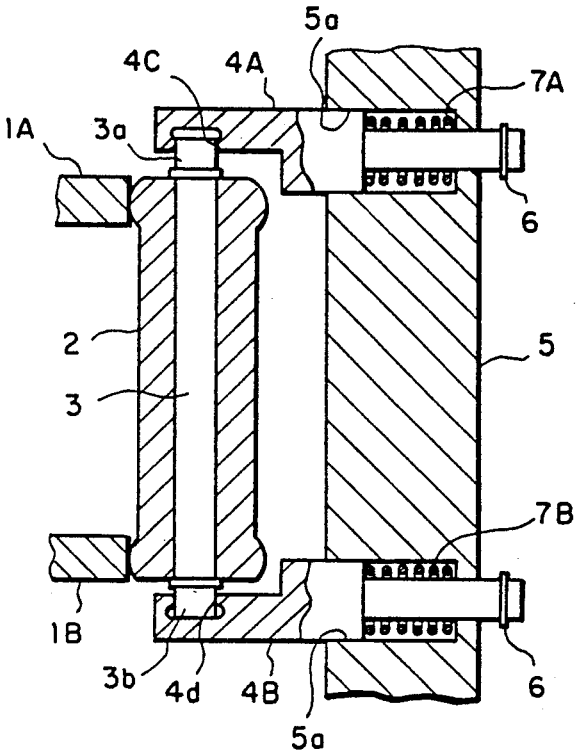
FIG. 1 (PRIOR ART)
FIG. 1 is a sectional view of a conventional roller contact device.
Figure 2:
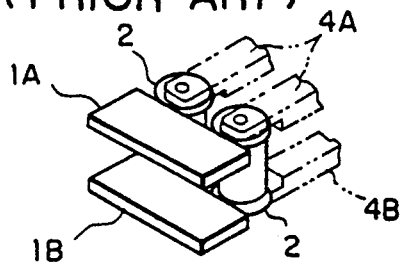
FIG. 2 (PRIOR ART)
FIG. 2 is a schematic perspective view of a conventional roller contact device employing a couple of roller contacts.
Figure 6:
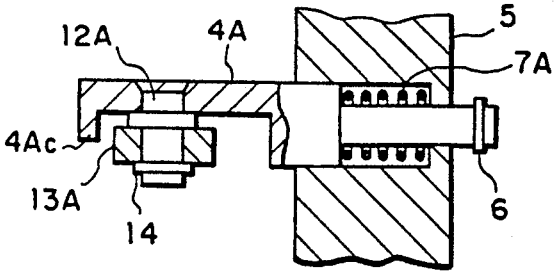
FIG. 6 is a fragmentary sectional view of a support shaft portion in another embodiment of the roller contact device according to the present invention.

Referring to FIG. 6, there is shown a support shaft in section and associated parts in another embodiment of the present invention. In this case, the support shaft 4A is provided with a stopper projection 4Ac at the fore end thereof to delimit to a desired value the rotational angle of the bridge link 13A which is supported on the pivot shaft 12A.

Although in the foregoing embodiments a play gap is provided around the journalled roller shaft end in the bearing hole of the bridge link to permit inclination of the roller contact, the opposite end portions of the roller shaft may be formed in a spherical shape as shown in the afore-mentioned Japanese Utility Model Publication No. 52-25638 if desired. Alternatively, there may be employed other support means which is adapted to support the end portion of the roller shaft tiltably in the bearing hole of the bridge link.

Although the roller contacts 2L and 2R have been described as being rotatably supported on the roller shafts 3L and 3R in the foregoing embodiments, they may be fixedly mounted on the roller shafts because the latter are rotatably supported in the bearing holes 13Aa and 13Ba of the bridge links 13A and 13B, respectively.

Moreover, although only a pair of stationary contacts are shown in the foregoing embodiments, a tap changer usually has a plural number of pairs of stationary contacts located along the rotational direction of the drive arm.

It will be appreciated from the foregoing description that the roller contact device according to the present invention employs an arrangement which requires only a pair of support shafts and a pair of compression springs for a couple of roller contacts, by the provision of a pair of support shafts supported on a drive arm movably in the back and forth directions and constantly urged in the forward direction each by a compression spring, a pair of bridge links each having a middle portion thereof supported on a fore end portion of one of the support shafts, a pair of roller shafts supported between confronting opposite end portions of the bridge links, and a pair of roller contacts supported on the roller shafts in parallel relation with each other for pressed contact with a pair of stationary contacts. Accordingly, the present invention contributes to reduce the steps of machining process of the drive arm, to simplify the assembling job and to make the construction compact as a whole.

What is claimed is:

1. A roller contact device, comprising:

a pair of support shafts each movably supported at one end on a drive are for back and forth movements and constantly urged in a forward direction by a compression spring;

a pair of pivot shafts individually supported on other ends of said support shafts;

a pair of bridge links individually rotatably supported at a middle portion thereof on said pivot shafts;

a pair of roller shafts, each having end portions, and supported parallelly between confronting opposite ends of said bridge links and rotatably and tiltably in back and forth directions;

a pair of roller contacts supported on said pair of roller shafts; and at least a pair of stationary contacts to be connected to each other as said pair of roller contacts are brought into pressed contact therewith.

2. A roller contact device as defined in claim 1, wherein said support shafts are each provided with a stepped portion on one end thereof delimiting a rotational angle of said bridge links.

3. A roller contact device as defined in claim 1, wherein said support shafts are each provided with a stopper projection at the other end thereof for delimiting a maximum forward protrusion of said bridge links.

4. A roller contact device as defined in claim 1, 2 or 3, wherein said bridge links are provided with bearing holes in opposite end portions thereof receiving end portions of said roller shafts with a play gap therearound to permit back and forth tilting of said roller shafts.

5. A roller contact device as defined in claim 1, 2 or 3, wherein said roller contacts are rotatably supported respectively on said roller shafts.

6. A roller contact device as defined in claim 1, 2 or 3, wherein said roller contacts are fixedly supported respectively on said roller shafts.

* * * * *

UNITED STATES PATENT AND TRADEMARK OFFICE

CERTIFICATE OF CORRECTION

PATENT NO. : 5,017,744

DATED : May 21, 1991

INVENTOR(S) : Kazuo Yoshida

It is certified that error appears in the above-identified patent and that said Letters Patent is hereby corrected as shown below:

Claim 1, column 5, line 13, after "drive", "are" should read -- arm --.

Signed and Sealed this

Fifteenth Day of December, 1992

*Attest:*

DOUGLAS B. COMER

*Attesting Officer*

*Acting Commissioner of Patents and Trademarks*